US007775326B2

(12) United States Patent
Yumura et al.

(10) Patent No.: US 7,775,326 B2
(45) Date of Patent: Aug. 17, 2010

(54) ELEVATOR APPARATUS

(75) Inventors: Takashi Yumura, Tokyo (JP); Takaharu Ueda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 84 days.

(21) Appl. No.: 11/721,867

(22) PCT Filed: Feb. 23, 2006

(86) PCT No.: PCT/JP2006/303292

§ 371 (c)(1),
(2), (4) Date: Jun. 15, 2007

(87) PCT Pub. No.: WO2006/093020

PCT Pub. Date: Sep. 8, 2006

(65) Prior Publication Data

US 2008/0142313 A1 Jun. 19, 2008

(30) Foreign Application Priority Data

Mar. 1, 2005 (JP) ..... 2005-055914

(51) Int. Cl.
*B66B 11/08* (2006.01)
*B66B 7/06* (2006.01)
*B66B 7/10* (2006.01)
*B66B 5/02* (2006.01)

(52) U.S. Cl. ..... 187/256; 187/393; 187/404; 187/412

(58) Field of Classification Search ..... 187/258, 187/404, 266, 414, 256, 262, 412; *B66B 7/06, B66B 7/10, 11/08*
See application file for complete search history.

(56) References Cited

U.S. PATENT DOCUMENTS

| | | | | | |
|---|---|---|---|---|---|
| 146,699 | A | * | 1/1874 | Moore | 187/266 |
| 719,466 | A | * | 2/1903 | Hiss | 254/292 |
| 735,093 | A | * | 8/1903 | Greenwald | 187/404 |
| 749,193 | A | * | 1/1904 | Hiss | 187/258 |
| 1,380,125 | A | * | 5/1921 | Turner | 187/412 |
| 1,700,587 | A | * | 1/1929 | Higbee | 187/412 |
| 1,820,427 | A | * | 8/1931 | Birmann | 187/349 |
| 1,891,115 | A | * | 12/1932 | Scott | 187/412 |

(Continued)

FOREIGN PATENT DOCUMENTS

EP 1538121 A1 * 6/2005

(Continued)

OTHER PUBLICATIONS

NPL Documents International Search Report.

*Primary Examiner*—John Q Nguyen
*Assistant Examiner*—Stefan Kruer
(74) *Attorney, Agent, or Firm*—Leydig, Voit & Mayer, Ltd.

(57) ABSTRACT

In an elevator apparatus, first and second raised/lowered bodies are raised and lowered by hoisting machines. The second raised/lowered body has a raised/lowered main body and a rocking member rockably connected to the raised/lowered main body. The raised/lowered main body is suspended by a main rope via the rocking member. The main rope has a first rope end connected to the rocking member on one side of a rocking center of the rocking member and a second rope end connected to the rocking member on another side of the rocking center.

2 Claims, 10 Drawing Sheets

U.S. PATENT DOCUMENTS

| | | | | |
|---|---|---|---|---|
| 1,944,772 | A * | 1/1934 | White | 187/265 |
| 5,009,288 | A | 4/1991 | Nakai et al. | |
| 6,193,017 | B1 * | 2/2001 | Koster | 187/258 |
| 6,488,121 | B2 * | 12/2002 | Itoh | 184/6.26 |
| 6,488,124 | B1 * | 12/2002 | Yasuda et al. | 187/254 |
| 2006/0175138 | A1 * | 8/2006 | Hashiguchi | 187/256 |

FOREIGN PATENT DOCUMENTS

| | | | |
|---|---|---|---|
| EP | 1 591 399 | | 11/2005 |
| FR | 2677341 | A3 * | 12/1992 |
| JP | 52057644 | A * | 5/1977 |
| JP | 05070055 | A * | 3/1993 |
| JP | 05201657 | A * | 8/1993 |
| JP | 05306083 | A * | 11/1993 |
| JP | 6-64863 | | 3/1994 |
| JP | 10-77171 | | 3/1998 |
| JP | 10-231077 | | 9/1998 |
| JP | 2001-261257 | | 9/2001 |
| JP | 2002-3128 | | 1/2002 |
| JP | 2006193293 | A * | 7/2006 |
| WO | WO 03104126 | A1 * | 12/2003 |

* cited by examiner

ELEVATOR APPARATUS

TECHNICAL FIELD

The present invention relates to an elevator apparatus employing a plurality of hoisting machines to raise/lower a single car.

BACKGROUND ART

In recent years, there have been demands for an elevator capable of transporting more passengers more speedily along with constructions of high-rise buildings. For satisfying such demands, enlargement of a car is conceivable as one method. To attain the enhancement of the car, however, a large-size hoisting machine with large torque and a large output is required, so the costs of manufacture, lifting/setup, and the like increase.

On the other hand, there has been proposed an elevator apparatus employing two hoisting machines to raise/lower a single car instead of increasing the size of a single hoisting machine. In this elevator apparatus, the car and a counterweight are provided with fall blocks, respectively, to eliminate an inconvenience ascribable to a difference in speed generated between the two hoisting machines (e.g., see Patent Document 1).

Patent Document 1: JP 07-42063 A

DISCLOSURE OF THE INVENTION

Problems to be Solved by the Invention

In the conventional elevator apparatus constructed as described above, the car and the counterweight are provided with the fall blocks, so an endless rope is required as a main rope. However, the endless rope is manufactured by connecting both ends of a single rope to each other, so it is difficult to eliminate a step at a joint of both ends of the rope. In consequence, vibrations are caused when the joint moves past drive sheaves or the fall blocks. Further, the cost of manufacture rises for the purpose of ensuring reliability of the joint.

The present invention has been made to solve the above-mentioned problems, and it is therefore an object of the present invention to provide an elevator apparatus that makes it possible to compensate a difference between running distances of a main rope made by a plurality of hoisting machines without employing an endless ropes as the main rope.

Means for Solving the Problems

An elevator apparatus according to the present invention includes: a plurality of hoisting machines having drive sheaves, respectively; at least one main rope wound around the drive sheaves; a first raised/lowered body suspended by the main rope to be raised and lowered by the hoisting machines; and a second raised/lowered body suspended by the main rope to be raised and lowered by the hoisting machines in a direction opposite to the first raised/lowered body, in which: the second raised/lowered body has a raised/lowered main body, and a rocking member rockably connected to the raised/lowered main body; the raised/lowered main body is suspended by the main rope via the rocking member; and the main rope has a first rope end connected to the rocking member on one side of a rocking center of the rocking member, and a second rope end connected to the rocking member on another side of the rocking center.

Further, an elevator apparatus according to the present invention includes: a plurality of hoisting machines having drive sheaves, respectively; at least one main rope wound around the drive sheaves; a first raised/lowered body suspended by the main rope to be raised and lowered by the hoisting machines; a second raised/lowered body suspended by the main rope to be raised and lowered by the hoisting machines in a direction opposite to the first raised/lowered body; abnormality detecting means for detecting whether or not a difference between running distances of the main rope generated by the hoisting machines reaches a set value set in advance; and a control device for outputting a command to stop the first raised/lowered body and the second raised/lowered body when the abnormality detecting means detects that the difference between the running distances of the main rope reaches the set value.

Still further, an elevator apparatus according to the present invention includes: a plurality of hoisting machines having drive sheaves, respectively; at least one main rope wound around the drive sheaves; a car suspended by the main rope to be raised and lowered by the hoisting machines; and a counterweight suspended by the main rope to be raised and lowered by the hoisting machines, in which: the counterweight has a first weight body, a second weight body, and a coupling member made of an elastic body for coupling the first weight body and the second weight body to each other; and the main rope has a first rope end connected to the counterweight on the first weight body side thereof, and a second rope end connected to the counterweight on the second weight body side thereof.

Yet further, an elevator apparatus according to the present invention includes: a plurality of hoisting machines having drive sheaves, respectively; at least one main rope wound around the drive sheaves; a first raised/lowered body suspended by the main rope to be raised and lowered by the hoisting machines; and a second raised/lowered body suspended by the main rope to be raised and lowered by the hoisting machines in a direction opposite to the first raised/lowered body, in which: the first raised/lowered body is provided with a balance pulley around which an intermediate portion of the main rope is looped; the main rope has a plurality of rope ends connected to an upper portion of the second raised/lowered body; and the rope ends are gathered in a vicinity of a center of gravity of the second raised/lowered body on a vertical projection plane.

Yet further, an elevator apparatus according to the present invention includes: a first hoisting machine disposed in an upper portion of a hoistway and having a first drive sheave; a second hoisting machine disposed in the upper portion of the hoistway and having a second drive sheave; at least one first main rope wound around the first drive sheave; at least one second main rope wound around the second drive sheave; and a first raised/lowered body and a second raised/lowered body that are suspended by the first main rope and the second main rope to be raised and lowered by the first hoisting machine and the second hoisting machine, in which: the first main rope has a first rope end connected to an upper portion of the first raised/lowered body, and a second rope end connected to an upper portion of the second raised/lowered body; the second main rope has a third rope end connected to the upper portion of the first raised/lowered body, and a fourth rope end connected to the upper portion of the second raised/lowered body; the first rope end and the third rope end are gathered in a vicinity of a center of gravity of the first raised/lowered body on a vertical projection plane with respect to a clearance between the first drive sheave and the second drive sheave; and the second rope end and the fourth rope end are gathered in a vicinity of a center of gravity of the second raised/lowered body on the vertical projection plane with respect to the clearance between the first drive sheave and the second drive sheave.

BEST MODES FOR CARRYING OUT THE INVENTION

Best modes for carrying out the present invention will be described hereinafter with reference to the drawings.

Embodiment 1

Figure 1:
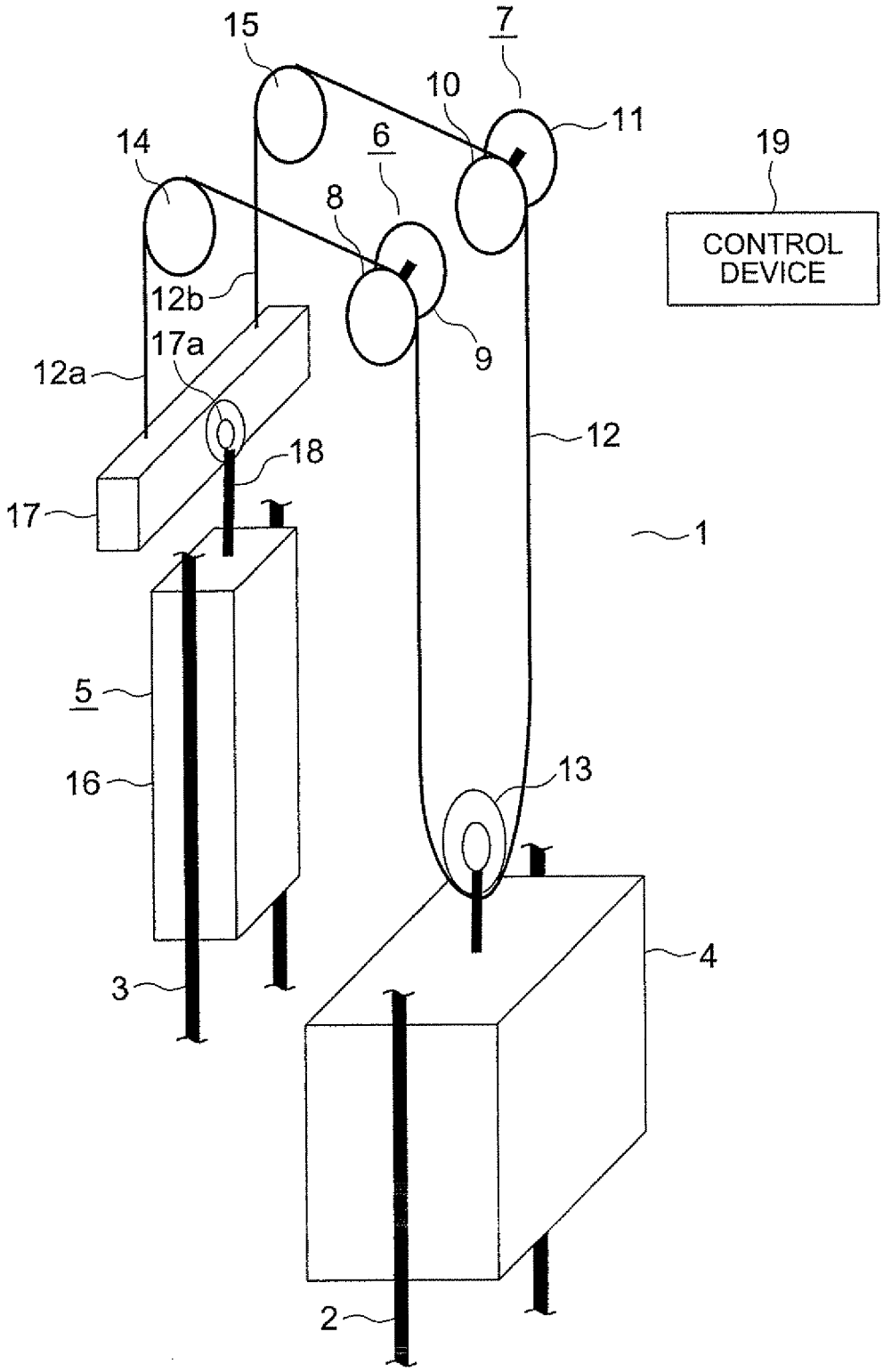
FIG. 1 is a perspective view showing an elevator apparatus according to Embodiment 1 of the present invention.

FIG. 1 is a perspective view showing an elevator apparatus according to Embodiment 1 of the present invention. Referring to FIG. 1, a pair of car guide rails 2 and a pair of counterweight guide rails 3 are installed within a hoistway 1. A car 4 serving as a first raised/lowered body is raised/lowered within the hoistway 1 along the car guide rails 2. A counterweight 5 serving as a second raised/lowered body is raised/lowered within the hoistway 1 along the counterweight guide rails 3.

The counterweight 5 has a counterweight body 16 serving as a raised/lowered main body, a rocking member (rope connection member) 17 rockably connected to the counterweight body 16, and a connection member 18 for connecting the counterweight body 16 and the rocking member 17 to each other. The counterweight body 16 is suspended from the rocking member 17 via the connection member 18.

The connection member 18 is turnably coupled at an upper end thereof to a rocking center of the rocking member 17, namely, a rocking shaft 17*a*. The rocking shaft 17*a* extends horizontally and parallel to a thickness direction of the counterweight body 16. The connection member 18 is connected at a lower end thereof to the center of an upper portion of the counterweight body 16. The connection member 18 is provided at the upper end thereof with rocking detecting means (not shown) for detecting a rocking state of the rocking member 17. Employed as the rocking detecting means is, for example, an encoder.

A first hoisting machine 6 and a second hoisting machine 7 are disposed in an upper portion of the hoistway 1. The first hoisting machine 6 has a first drive sheave 8, and a first hoisting machine body 9 for rotating the first drive sheave 8. The second hoisting machine 7 has a second drive sheave 10, and a second hoisting machine body 11 for rotating the second drive sheave 10. Each of the first hoisting machine body 9 and the second hoisting machine body 11 includes an electric motor. The first hoisting machine 6 and the second hoisting machine 7 are disposed such that rotary shafts of the drive sheaves 8 and 10 extend horizontally.

At least one main rope 12 is wound around the first drive sheave 8 and the second drive sheave 10. The car 4 and the counterweight 5, which are suspended within the hoistway 1 by means of the main rope 12, are raised/lowered within the hoistway 1 due to driving forces of the first hoisting machine 6 and the second hoisting machine 7. The counterweight 5 is raised/lowered in the direction opposite to the car 4.

The main rope 12 has a first rope end 12*a* connected to the rocking member 17 on one side of the rocking shaft 17*a* of the rocking member 17, and a second rope end 12*b* connected to the rocking member 17 on the other side of the rocking shaft 17*a*. The first rope end 12*a* and the second rope end 12*b* are connected to the rocking member 17 at positions equidistant from the rocking shaft 17*a*.

A first deflector pulley 14 for leading the first rope end 12*a* to the counterweight 5 and a second deflector pulley 15 for leading the second rope end 12*b* to the counterweight 5 are disposed in the upper portion of the hoistway 1. The first deflector pulley 14 and the second deflector pulley 15 are disposed such that rotary shafts thereof extend horizontally.

A balance pulley 13 rotatable around a horizontal rotary shaft is provided above the car 4. An intermediate portion of the main rope 12 is wound around the balance pulley 13.

The first hoisting machine 6 and the second hoisting machine 7 are controlled by a control device 19. In response to a signal from the rocking detecting means, the control device 19 controls the first hoisting machine 6 and the second hoisting machine 7 so as to counterbalance the rocking of the rocking member 17, namely, to return the rocking member 17 to a horizontal state.

In the elevator apparatus constructed as described above, the first hoisting machine 6 and the second hoisting machine 7 are controlled by the control device 19 so as to be operated in synchronization with each other. However, owing to a manufacturing error between the drive sheaves 8 and 10, a minor slippage caused between each of the drive sheaves 8 and 10 and the main rope 12 at the time of acceleration/deceleration, braking, or the like of the car 4, fluctuations in the torques of the hoisting machine bodies 9 and 11, and the like, there is an error generated between the running distance of the main rope 12 on the first drive sheave 8 side with respect to the car 4 and the running distance of the main rope 12 on the second drive sheave 10 side with respect to the car 4.

The error between the running distances as described above is compensated by the rocking (inclination) of the rocking member 17, which serves as a scale-type balance mechanism. In this case, a resultant force of the first rope end 12*a* and the second rope end 12*b* vertically supports the counterweight body 16 even when the rocking member 17 is inclined, so no inclination-causing moment is applied to the counter weight body 16. Accordingly, the difference between the running distances of the main rope 12 made by the two hoisting machines 6 and 7 can be compensated through the rocking of the rocking member 17 without employing an endless rope as the main rope 12. Further, there is no need to divide the counterweight 5 in two, so an increase in cost can be suppressed.

When the rocking member 17 is inclined, the first hoisting machine 6 and the second hoisting machine 7 are controlled so as to counterbalance the inclination of the rocking member 17. That is, in the control device 19, speed control correction values for counterbalancing the error between the running distances are calculated and added to speed command values for the electric motors of the hoisting machines 6 and 7. As a result, the rocking member 17 can be prevented from being inclined by a limit value or more through the accumulation of errors over time.

In the foregoing example, the car 4 and the counterweight 5 are the first raised/lowered body and the second raised/lowered body, respectively. However, the counterweight 5 and the car 4 may be the first raised/lowered body and the second raised/lowered body, respectively, and the car 4 may be provided with the rocking member 17.

In the foregoing example, the rocking member 17 is provided only on the second raised/lowered body side. However, another rocking member may be provided on the first raised/lowered body side as well. More specifically, it is appropriate to divide the main rope 12 in two and provide the car 4 with the rocking member instead of employing the balance pulley 13.

Further, the hoisting machines 6 and 7 may be disposed at the positions of the deflector pulleys 14 and 15, respectively.

Still further, the balance mechanism should not be limited to the rocking member 17. For example, compression springs interposed between the first rope end 12*a* and the counterweight 5 and between the second rope end 12*b* and the counterweight 5, respectively, may be employed to compensate for an error between running distances through a difference between expansion/contraction strokes of the compression springs. Hydraulic cylinders or link mechanisms each composed of a plurality of combined links may also be employed instead of the compression springs.

Accordingly, the means for detecting the difference between the running distances should not be limited to the rocking detecting means. In accordance with the construction of the balance mechanism, the means for detecting the difference between the running distances may be realized as, for example, a displacement gauge for detecting expansion/contraction strokes of the compression springs or the hydraulic cylinders, or a displacement gauge for detecting displacement of the links.

Embodiment 2

Figure 2:
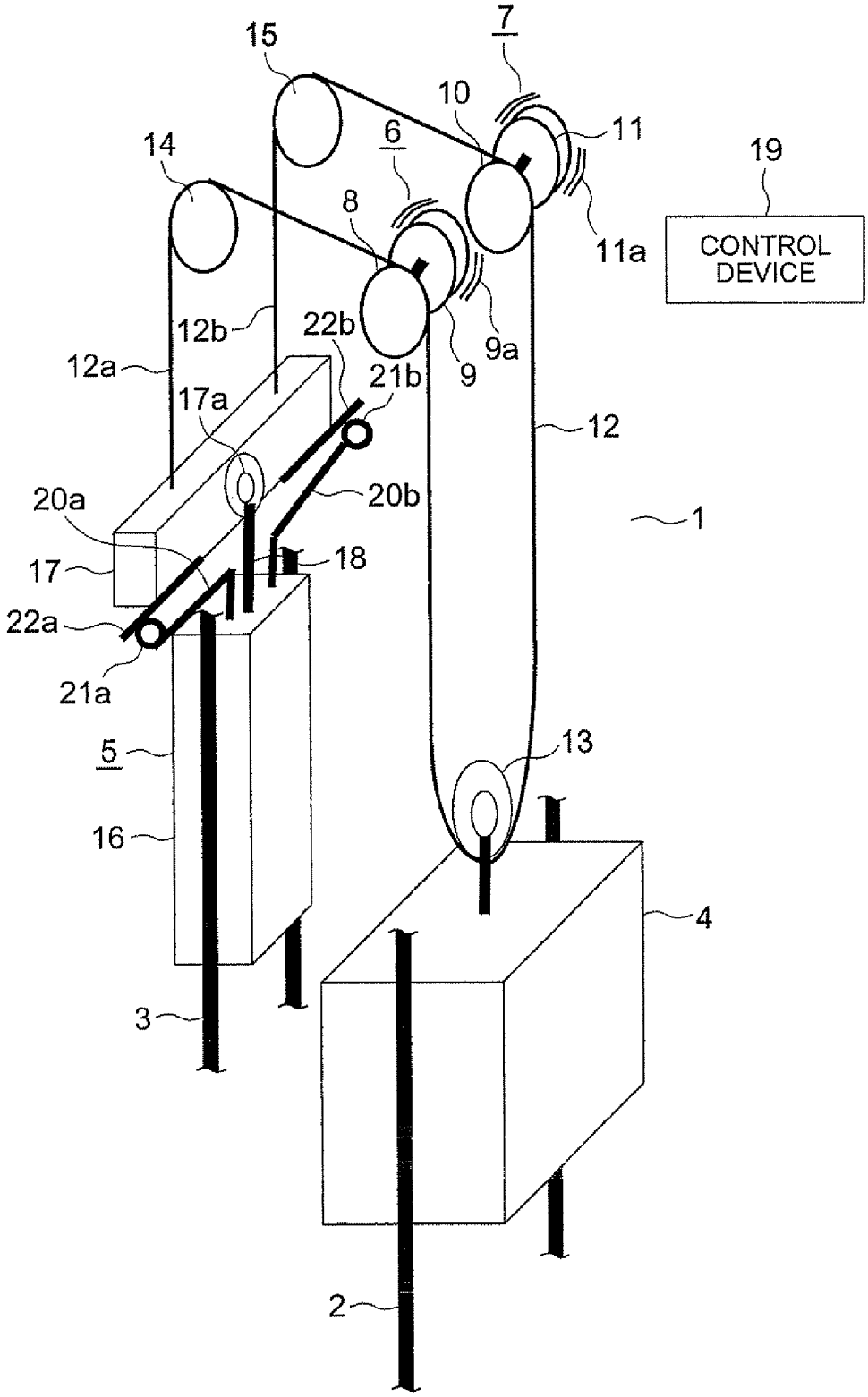
FIG. 2 is a perspective view showing an elevator apparatus according to Embodiment 2 of the present invention.

Reference will be made next to FIG. 2. FIG. 2 is a perspective view showing an elevator apparatus according to Embodiment 2 of the present invention. Referring to FIG. 2, a pair of switch mounting arms 20*a* and 20*b* are provided on the counterweight body 16. The switch mounting arms 20*a* and 20*b* are mounted at tips thereof with switches 21*a* and 21*b*, respectively, whose contacts are mechanically opened/closed. The rocking member 17 is mounted with operating strips 22*a* and 22*b* for operating the switches 21*a* and 21*b*, respectively.

Abnormality detecting means for detecting whether or not the difference between the running distances of the main rope 12 made by the first hoisting machine 6 and the second hoisting machine 7 has reached a set value set in advance has the switch mounting arms 20*a* and 20*b*, the switches 21*a* and 21*b*, and the operating strips 22*a* and 22*b*.

Although omitted in FIG. 1, the hoisting machine bodies 9 and 11 are provided with brake portions 9*a* and 11*a* for braking rotation of the drive sheaves 8 and 10, respectively. When the abnormality detecting means detects that the difference between the running distances of the main rope 12 has reached the set value, the control device 19 stops the car 4 and the counterweight 5 as an emergency measure. Embodiment 2 of the present invention is identical to Embodiment 1 of the present invention in other constructional details.

Next, an operation will be described. In a state in which the difference between the running distances of the main rope 12 is small and the rocking member 17 is held substantially horizontal, the operating strips 22*a* and 22*b* are in contact with the switches 21*a* and 21*b*, respectively. However, when the difference between the running distances of the main rope 12 increases and the angle of inclination of the rocking member 17 reaches a set value, the contact of one of the switches 21*a* and 21*b* is opened.

Switch signals output from the switches 21*a* and 21*b* are input to the control device 19. As a result, a command to stop the car 4 is output from the control device 19. That is, power supplies for the hoisting machine bodies 9 and 11 are shut off, and the drive sheaves 8 and 10 are braked by the brake portions 9*a* and 11*a*, respectively, so the car 4 and the counterweight 5 are decelerated and stopped.

In the elevator apparatus constructed as described above, the car 4 and the counterweight 5 do not run while the rocking member 17 remains inclined by a prescribed value or more, so reliability can be improved.

Normally open contacts or normally closed contacts that are opened/closed through a power-supply voltage may be employed as the contacts of the switches 21*a* and 21*b*.

In Embodiment 2 of the present invention, the abnormality detecting means is provided between the counterweight body 16 and the rocking member 17. However, the abnormality detecting means may be provided in another region as long as there is a difference between running distances of the main rope 12 made by the two hoisting machines 6 and 7 in the region. In FIG. 2, for example, the switches 21*a* and 21*b* may be provided, respectively, on cleat spring portions (not shown) provided between the deflector pulleys 14 and 15 or between the rope ends 12*a* and 12*b*.

Embodiment 3

Figure 3:
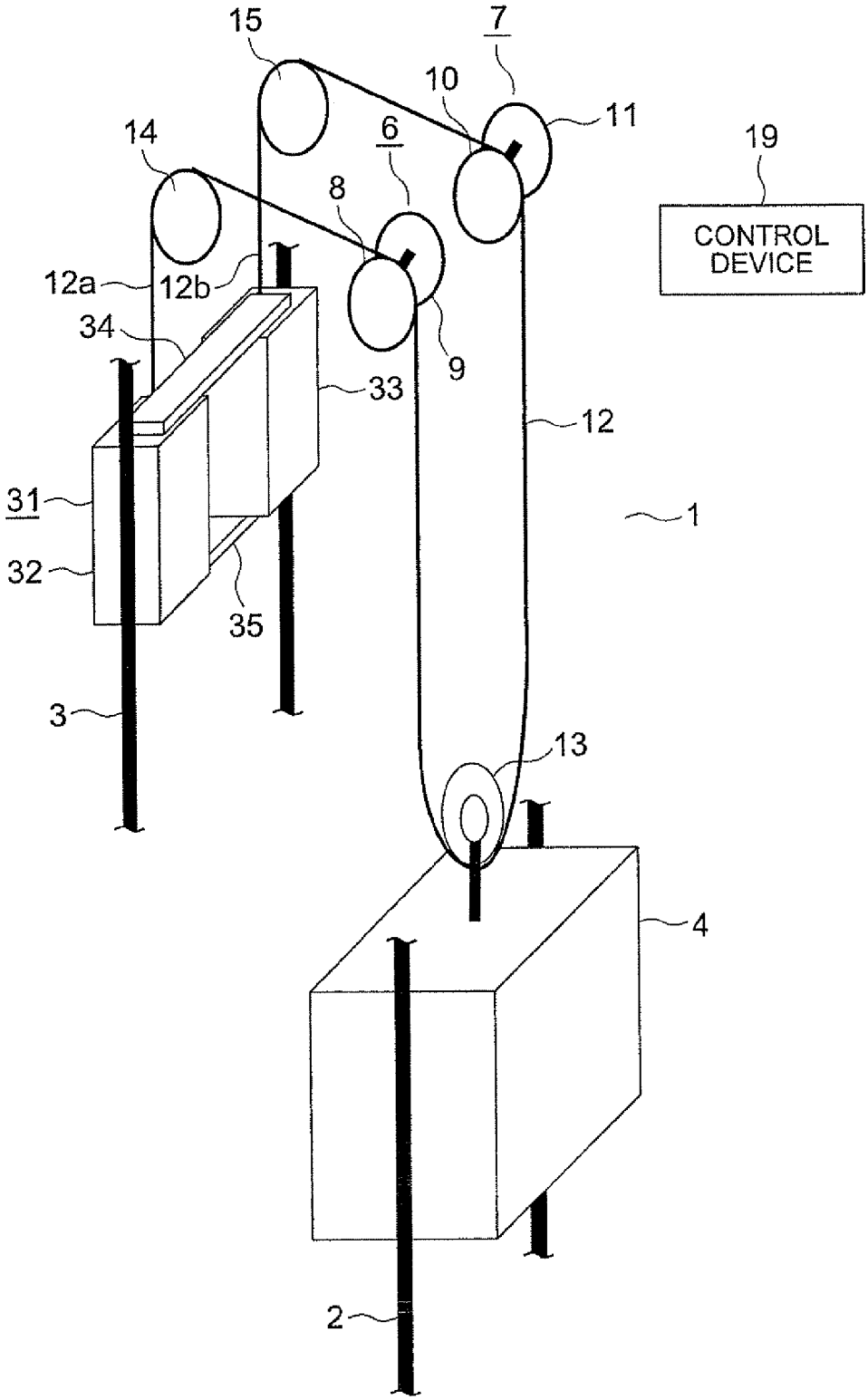
FIG. 3 is a perspective view showing an elevator apparatus according to Embodiment 3 of the present invention.

Reference will be made next to FIG. 3. FIG. 3 is a perspective view showing an elevator apparatus according to Embodiment 3 of the present invention. Referring to FIG. 3, a counterweight 31 has a first weight body 32 and a second weight body 33 that are disposed apart from each other and side by side in a width direction of the counterweight 31, and a pair of coupling members 34 and 35 made of flat plate-shaped elastic bodies for coupling the first weight body 32 and the second weight body 33 to each other at upper portions and lower portions thereof, respectively.

The first rope end 12*a* of the main rope 12 is connected to the counterweight 31 on the first weight body 32 side thereof. The second rope end 12*b* of the main rope 12 is connected to the counterweight 31 on the second weight body 33 side thereof. That is, the first weight body 32 is mainly supported by the first rope end 12*a*, and the second weight body 33 is mainly supported by the second rope end 12*b*.

Deformation states of the coupling members 34 and 35 are detected by deformation detecting means (not shown). Employable as the deformation detecting means are, for example, strain gauges provided on the coupling members 34 and 35 or displacement gauges for detecting relative displacement between the weight bodies 32 and 33. In response to signals from the deformation detecting means, the control device 19 controls the first hoisting machine 6 and the second hoisting machine 7 so as to counterbalance deformation of the coupling members 34 and 35, namely, to equalize the heights of the weight bodies 32 and 33 with each other.

In the elevator apparatus constructed as described above, when a difference is generated between the running distances of the main rope 12, the coupling members 34 and 35 are elastically deformed to generate a difference between the heights of the first weight body 32 and the second weight body 33. The difference between the running distances of the main rope 12 is compensated by the difference between the heights, so no inclination-causing moment is applied to the counterweight 31. Accordingly, the difference between the running distances of the main rope 12 made by the two hoisting machines 6 and 7 can be compensated without employing an endless rope as the main rope 12. The two weight bodies 32 and 33 are provided whereas only the single counterweight 31 is provided. Therefore, there is no need to provide more than a single set of the counterweight guide rails 3, so an increase in cost can be suppressed.

When the coupling members 34 and 35 are deformed, the first hoisting machine 6 and the second hoisting machine 7 are controlled so as to counterbalance the deformation of the coupling members 34 and 35. That is, in the control device 19, speed control correction values for counterbalancing an error between running distances are calculated and added to speed command values for the electric motors of the hoisting machines 6 and 7. As a result, the coupling members 34 and 35 can be prevented from being deformed by a limit value or more through the accumulation of errors over time.

Embodiment 4

Figure 4:
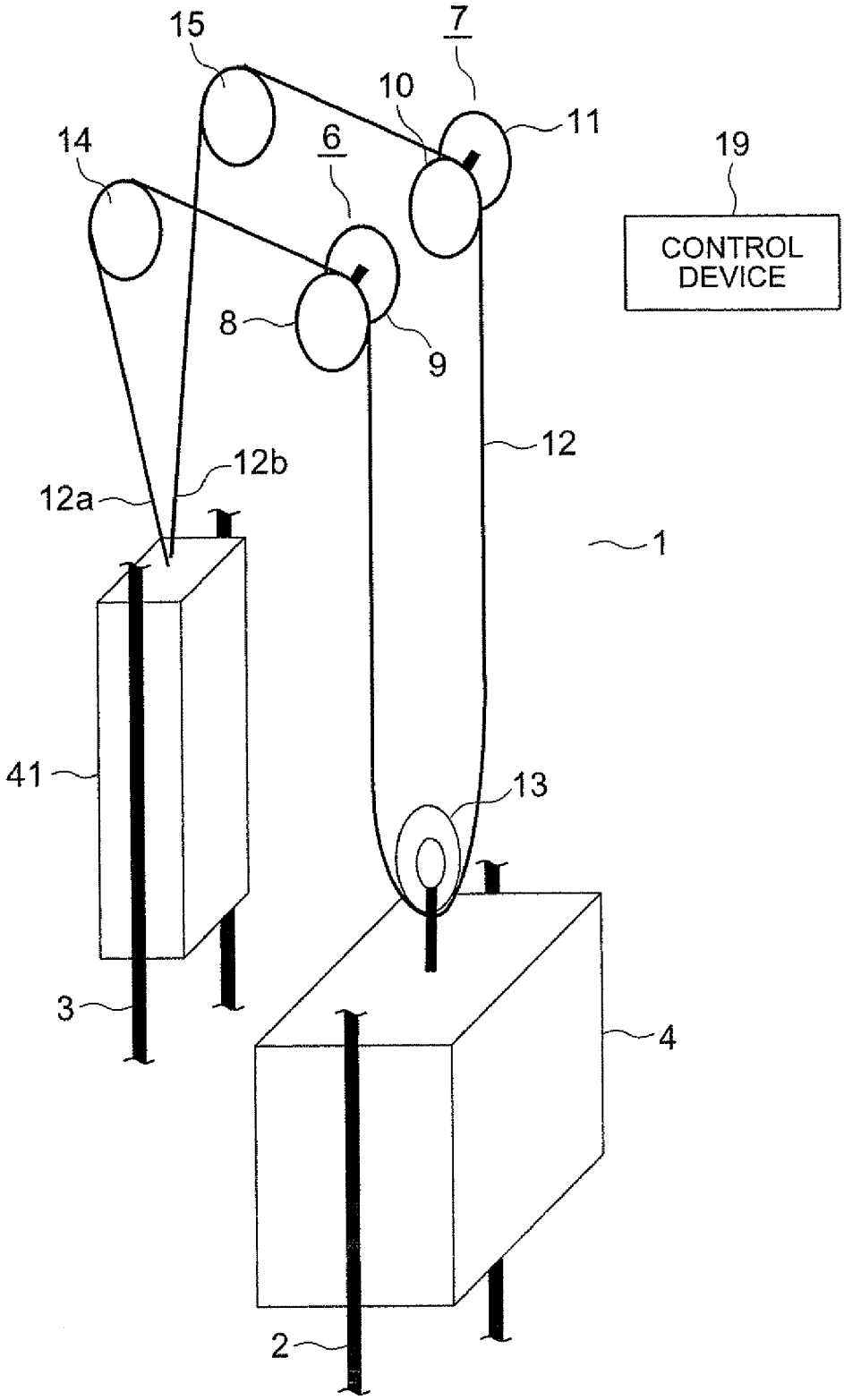
FIG. 4 is a perspective view showing an elevator apparatus according to Embodiment 4 of the present invention.

Reference will be made next to FIG. 4. FIG. 4 is a perspective view showing an elevator apparatus according to Embodiment 4 of the present invention. Referring to FIG. 4, the first rope end 12*a* and the second rope end 12*b* are gathered in the vicinity of the center of gravity of a counterweight 41 as the second raised/lowered body on a vertical projection plane. That is, those portions of the rope ends 12*a* and 12*b* which are connected to the counterweight 41 are disposed as close as structurally possible to the centroidal line of the counterweight 41.

In the elevator apparatus constructed as described above, when a difference is generated between the running distances of the main rope 12, compensation for this difference is realized through a difference between respective expansion strokes of the main rope 12 from the hoisting machines 6 and 7 to the counterweight 41. The difference between the expansion strokes of the main rope 12 leads to a difference between rope tensile forces and acts on the counterweight 41. However, the rope ends 12*a* and 12*b* are in proximity to the centroidal line of the counterweight 41, so the magnitude of a moment inclining the counterweight 41 is small. As a result, no inconvenience is caused. Accordingly, the difference between the running distances of the main rope 12 made by the two hoisting machines 6 and 7 can be compensated without employing an endless rope as the main rope 12.

With the construction described above, it is conceivable that the main rope 12 is greatly inclined between the deflector pulleys 14 and 15 and the counterweight 41, that a horizontal force is applied to the counterweight 41, and that the respective fleet angles between rope grooves of the deflector pulleys 14 and 15 and the main rope 12 are increased. However, this problem is solved by, for example, minimizing the distance between the hoisting machines 6 and 7 or the distance between the deflector pulleys 14 and 15 insofar as the hoisting machines 6 and 7 or the deflector pulleys 14 and 15 do not interfere with each other.

Embodiment 5

Figure 5:
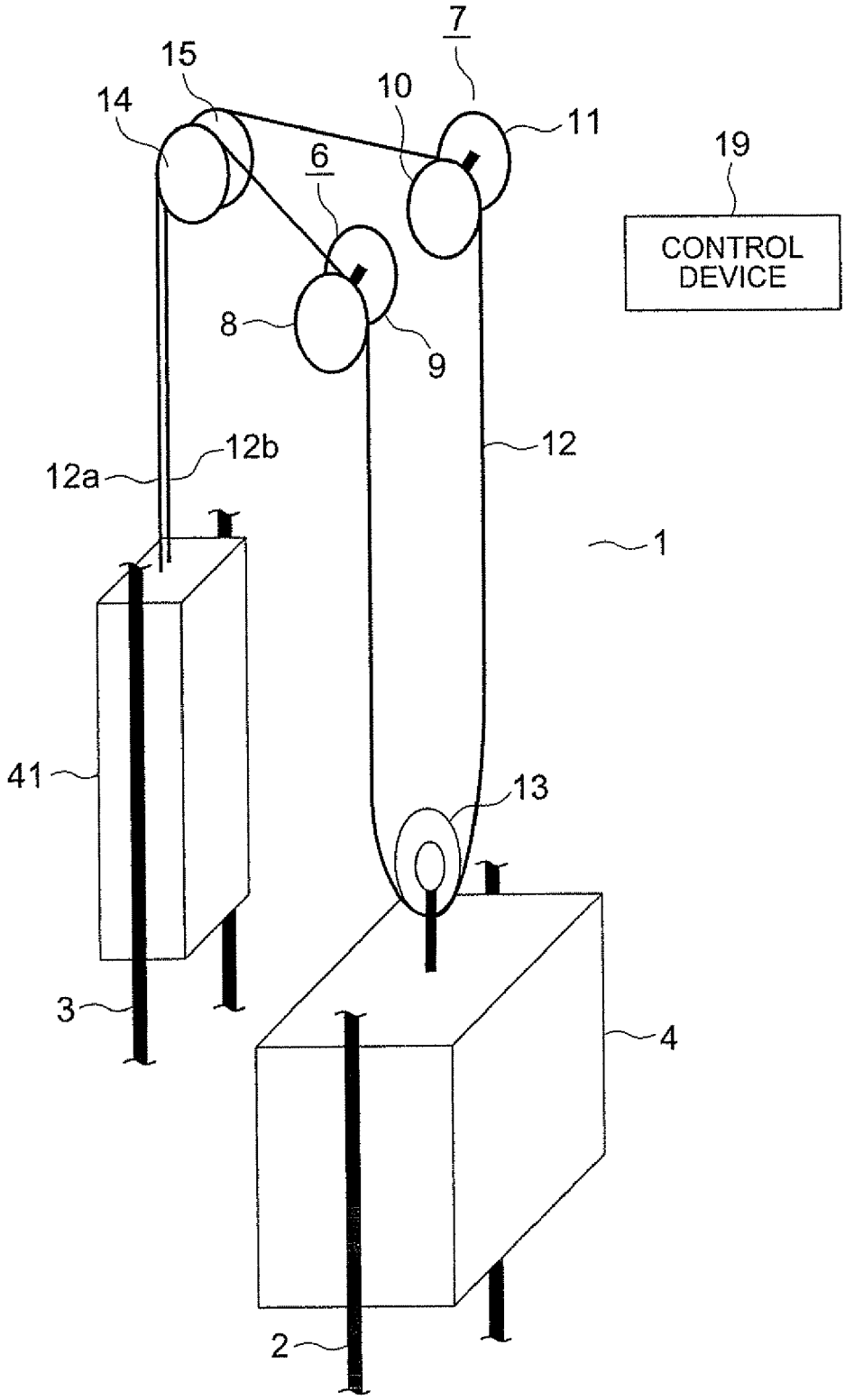
FIG. 5 is a perspective view showing an elevator apparatus according to Embodiment 5 of the present invention.

Reference will be made next to FIG. 5. FIG. 5 is a perspective view showing an elevator apparatus according to Embodiment 5 of the present invention. Referring to FIG. 5, the clearance between the first deflector pulley 14 and the second deflector pulley 15 is narrower than the clearance between the first drive sheave 8 and the second drive sheave 10. As a result, the first rope end 12*a* and the second rope end 12*b* are gathered in the vicinity of the center of gravity of the counterweight 41 on the vertical projection plane. Embodiment 5 of the present invention is identical to Embodiment 4 of the present invention in other constructional details.

In the elevator apparatus constructed as described above, those portions of the main rope 12 which are located between the deflector pulleys 14 and 15 and the counterweight 41 can be disposed substantially vertically, so the fleet angle of the main rope 12 with respect to each of the deflector pulleys 14 and 15 can be held small regardless of the position of the counterweight 41. As a result, the counterweight 41 can be suspended stably.

Embodiment 6

Figure 6:
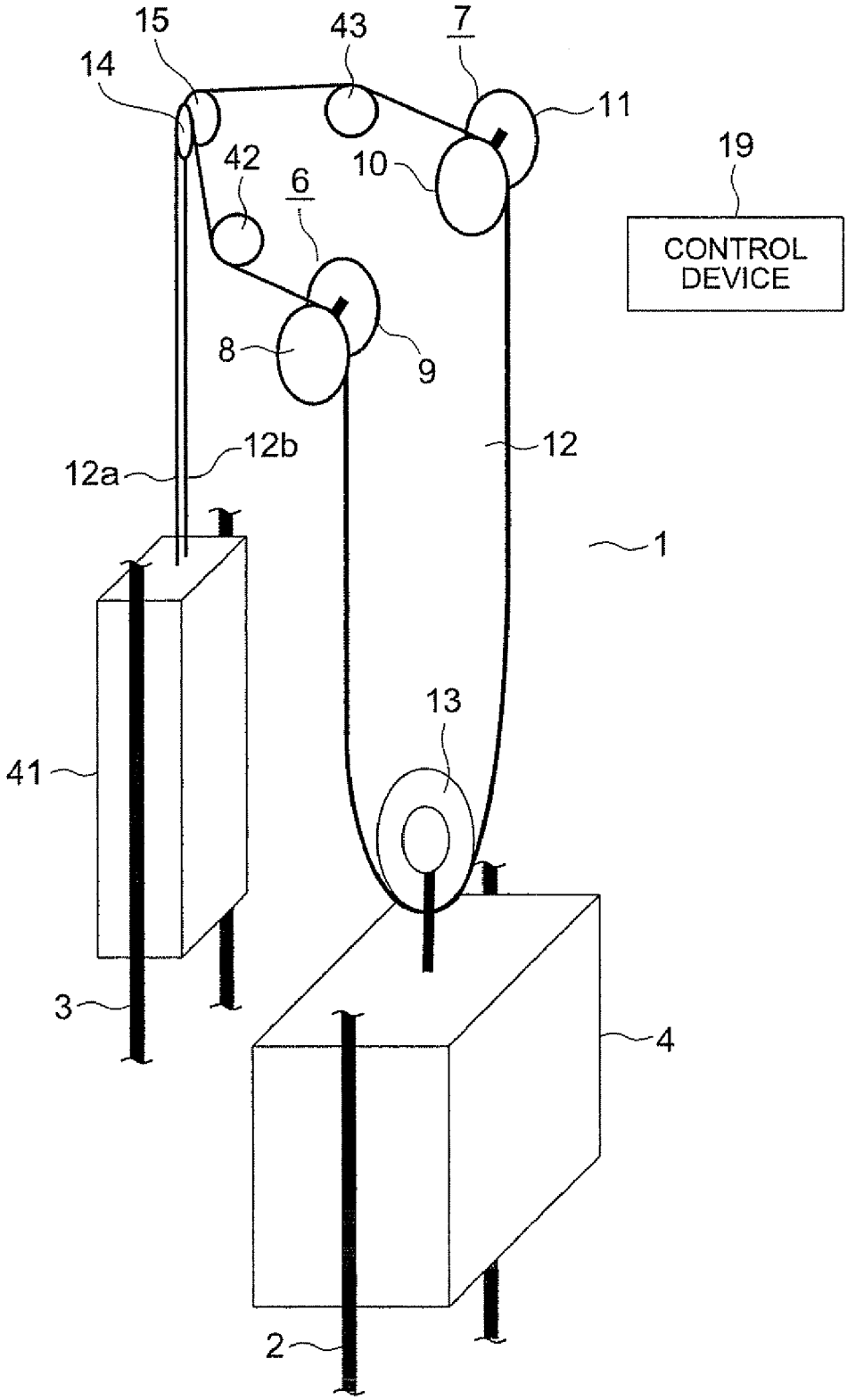
FIG. 6 is a perspective view showing an elevator apparatus according to Embodiment 6 of the present invention.

Reference will be made next to FIG. 6. FIG. 6 is a perspective view showing an elevator apparatus according to Embodiment 6 of the present invention. Referring to FIG. 6, a first turning pulley 42 for leading the main rope 12 from the drive sheave 8 to the deflector pulley 14 and a second turning pulley 43 for leading the main rope 12 from the drive sheave 10 to the deflector pulley 15 are disposed in the upper portion of the hoistway 1. The turning pulleys 42 and 43 are disposed such that rotary shafts thereof extend vertically (or substantially vertically). Embodiment 6 of the present invention is identical to Embodiment 5 of the present invention in other constructional details.

By employing the turning pulleys 42 and 43 disposed as described above, the degree of freedom in disposing the main rope 12 in the upper portion of the hoistway 1 can be enhanced.

In each of Embodiments 4 to 6 of the present invention, the counterweight 41 is the second raised/lowered body. However, the car 4 may be the second raised/lowered body. That is, the counterweight 41 may be provided with the balance pulley 13, and the rope ends 12*a* and 12*b* may be disposed in proximity to the centroidal line of the car 4.

The rocking member 17 as illustrated in Embodiment 1 of the present invention may be employed instead of the balance pulley 13.

Embodiment 7

Figure 7:
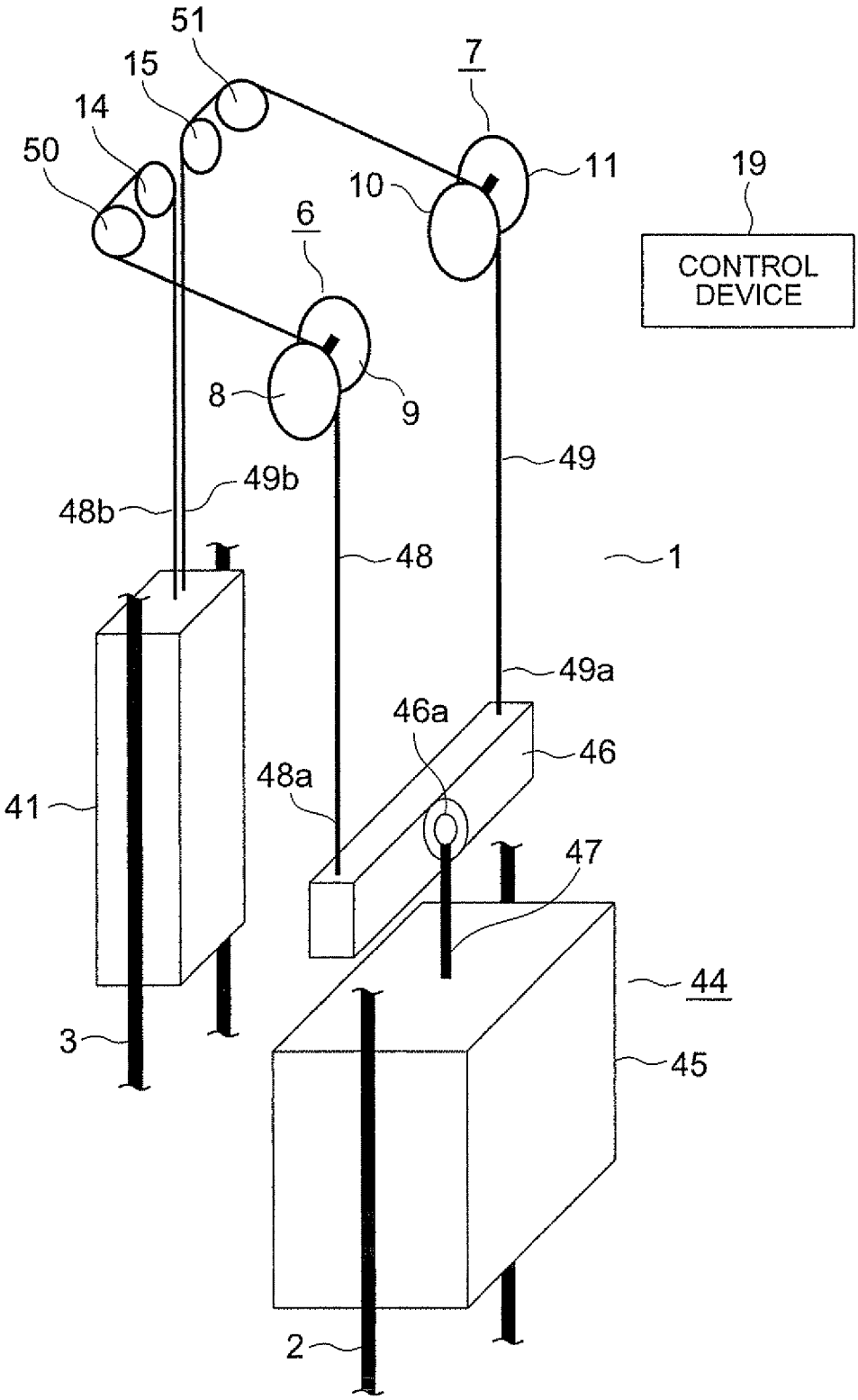
FIG. 7 is a perspective view showing an elevator apparatus according to Embodiment 7 of the present invention.

Reference will be made next to FIG. 7. FIG. 7 is a perspective view showing an elevator apparatus according to Embodiment 7 of the present invention. Referring to FIG. 7, a car 44 has a car body 45 serving as a raised/lowered main body, a rocking member 46 rockably connected to the car body 45, and a connection member 47 for connecting the car body 45 and the rocking member 46 to each other. The car body 45 is suspended from the rocking member 46 via the connection member 47.

The connection member 47 is turnably connected at an upper end thereof to a rocking center of the rocking member 46, namely, a rocking shaft 46*a*. The rocking shaft 46*a* extends horizontally and parallel to the depth direction of the car body 45. The connection member 47 is connected at a lower end thereof to the center of an upper portion of the car body 45.

A main rope group for suspending the car 44 and the counter weight 41 includes at least one first main rope 48 wound around the first drive sheave 8, and at least one second main rope 49 wound around the second drive sheave 10.

The first main rope 48 has a first rope end 48*a* connected to the rocking member 46 on one side of the rocking shaft 46*a*, and a second rope end 48*b* connected to an upper portion of the counterweight 41. The second main rope 49 has a third rope end 49*a* connected to the rocking member 46 on the other side of the rocking shaft 46*a*, and a fourth rope end 49*b* connected to the upper portion of the counterweight 41. The first rope end 48*a* and the third rope end 49*a* are connected to the rocking member 46 at positions equidistant from the rocking shaft 46*a*.

A first turning pulley 50 for turning the first main rope 48 from the first drive sheave 8 to lead the first main rope 48 to the first deflector pulley 14, and a second turning pulley 51 for turning the second main rope 49 from the second drive sheave 10 to lead the second main rope 49 to the second deflector pulley 15 are disposed in the upper portion of the hoistway 1. The first turning pulley 50 and the second turning pulley 51 are disposed such that rotary shafts thereof extend vertically (or substantially vertically).

In the elevator apparatus constructed as described above, when a difference is generated between the running distances of the main ropes 48 and 49, compensation for this difference is realized through the inclination of the rocking member 46. The second rope end 48*b* and the fourth rope end 49*b* are in proximity to the centroidal line of the counterweight 41, so the magnitude of a moment inclining the counterweight 41 is small and no inconvenience is caused even when a difference between the tensile forces applied to the main ropes 48 and 49 is generated due to incomplete compensation of the difference between the running distances of the main ropes 48 and 49. Accordingly, the difference between the running distances of the main ropes 48 and 49 made by the two hoisting machines 6 and 7 can be compensated without employing endless ropes as the main ropes 48 and 49.

Embodiment 8

Figure 8:
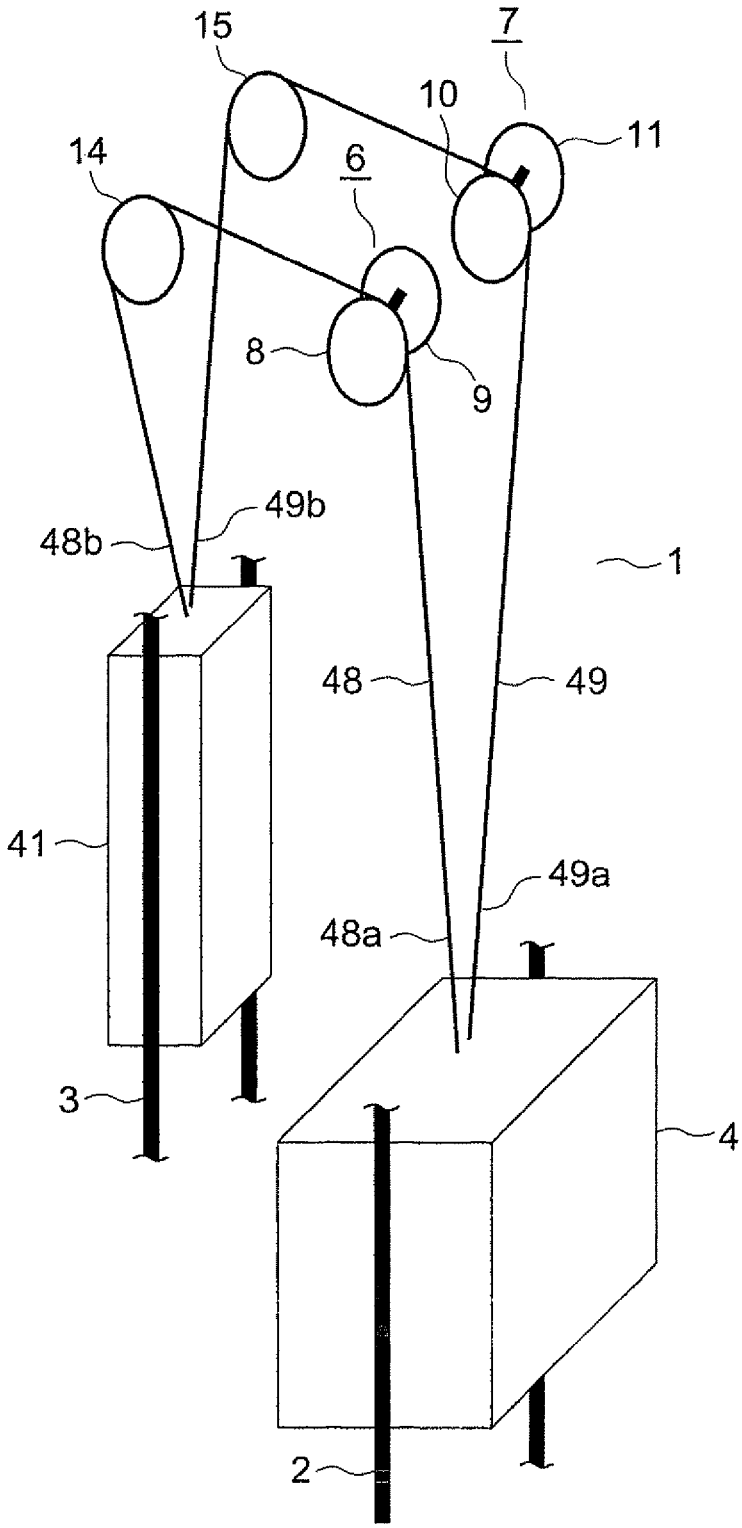
FIG. 8 is a perspective view showing an elevator apparatus according to Embodiment 8 of the present invention.

Reference will be made next to FIG. 8. FIG. 8 is a perspective view showing an elevator apparatus according to Embodiment 8 of the present invention. Referring to FIG. 8, the first rope end 48*a* and the third rope end 49*a* are gathered in the vicinity of the center of gravity of the car 4 on the vertical projection plane with respect to the clearance between the first drive sheave 8 and the second drive sheave 10. That is, those portions of the rope ends 48*a* and 49*a* which are connected to the car 4 are disposed as close as structurally possible to the centroidal line of the car 4.

The second rope end 48*b* and the fourth rope end 49*b* are gathered in the vicinity of the center of gravity of the counterweight 41 on the vertical projection plane with respect to the clearance between the first drive sheave 8 and the second drive sheave 10. That is, those portions of the rope ends 48*b* and 49*b* which are connected to the counterweight 41 are disposed as close as structurally possible to the centroidal line of the counterweight 41. Embodiment 8 of the present invention is identical to Embodiment 4 of the present invention in other constructional details.

In the elevator apparatus constructed as described above, the first rope end 48*a* and the third rope end 49*a* are in proximity to the centroidal line of the car 4, and the second rope end 48*b* and the fourth rope end 49*b* are in proximity to the centroidal line of the counterweight 41, so the magnitudes of moments inclining the car 4 and the counterweight 41 are small and no inconvenience is caused even when a difference between the tensile forces applied to the main ropes 48 and 49 is generated due to a difference between the running distances of the main ropes 48 and 49. Accordingly, the difference between the running distances of the main ropes 48 and 49 made by the two hoisting machines 6 and 7 can be compensated without employing endless ropes as the main ropes 48 and 49.

Embodiment 9

Figure 9:
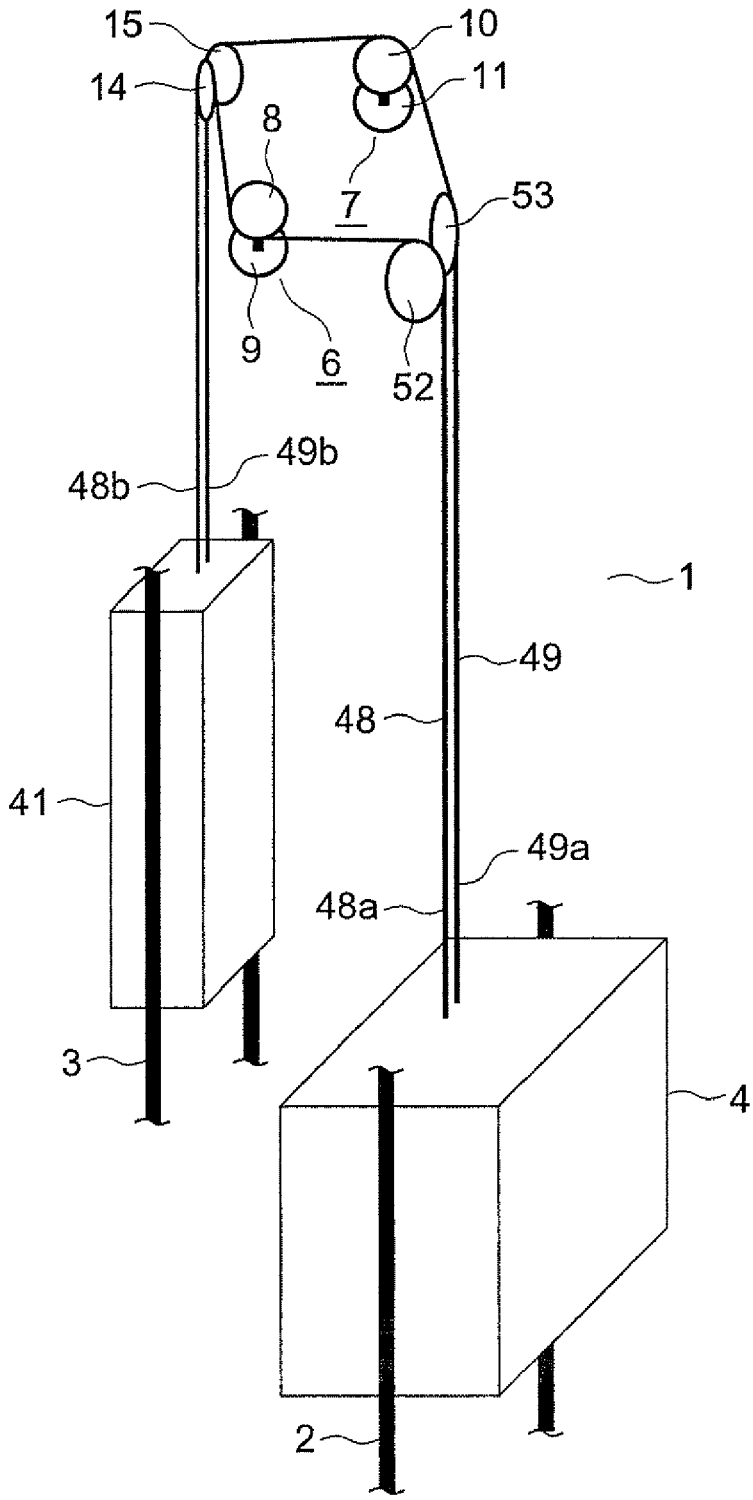
FIG. 9 is a perspective view showing an elevator apparatus according to Embodiment 9 of the present invention.

Reference will be made next to FIG. 9. FIG. 9 is a perspective view showing an elevator apparatus according to Embodiment 9 of the present invention. Referring to FIG. 9, the first hoisting machine 6 and the second hoisting machine 7 are disposed such that the rotary shafts of the drive sheaves 8 and 10 extend vertically (or substantially vertically). A low profile hoisting machine that is shorter in dimension in an axial direction thereof than in a direction perpendicular to the axial direction is employed as each of the first hoisting machine 6 and the second hoisting machine 7.

The first deflector pulley 14 for leading the main rope 48 from the drive sheave 8 to the counterweight 41, the second deflector pulley 15 for leading the main rope 49 from the drive sheave 10 to the counterweight 41, a third deflector pulley 52 for leading the main rope 48 from the drive sheave 8 to the car 4, and a fourth deflector pulley 53 for leading the main rope 49 from the drive sheave 10 to the car 4 are disposed in the upper portion of the hoistway 1.

The first rope end 48*a* and the third rope end 49*a* are gathered in the vicinity of the center of gravity of the car 4 on the vertical projection plane with respect to the clearance between the first drive sheave 8 and the second drive sheave 10. The second rope end 48*b* and the fourth rope end 49*b* are gathered in the vicinity of the center of gravity of the counterweight 41 on the vertical projection plane with respect to the clearance between the first drive sheave 8 and the second drive sheave 10.

In the elevator apparatus constructed as described above, the first rope end 48*a* and the third rope end 49*a* are in proximity to the centroidal line of the car 4, and the second rope end 48*b* and the fourth rope end 49*b* are in proximity to the centroidal line of the counterweight 41, so the magnitudes of moments inclining the car 4 and the counterweight 41 are small and no inconvenience is caused even when a difference between the tensile forces applied to the main ropes 48 and 49 is generated due to a difference between the running distances of the main ropes 48 and 49. Accordingly, the difference between the running distances of the main ropes 48 and 49 made by the two hoisting machines 6 and 7 can be compensated without employing endless ropes as the main ropes 48 and 49.

The low-profile hoisting machine is employed as each of the first hoisting machine 6 and the second hoisting machine 7, and the first hoisting machine 6 and the second hoisting machine 7 are disposed in the upper portion of the hoistway 1 such that the drive sheaves 8 and 10 extend vertically. Therefore, the space in the upper portion of the hoistway 1 can be saved.

Embodiment 10

Figure 10:
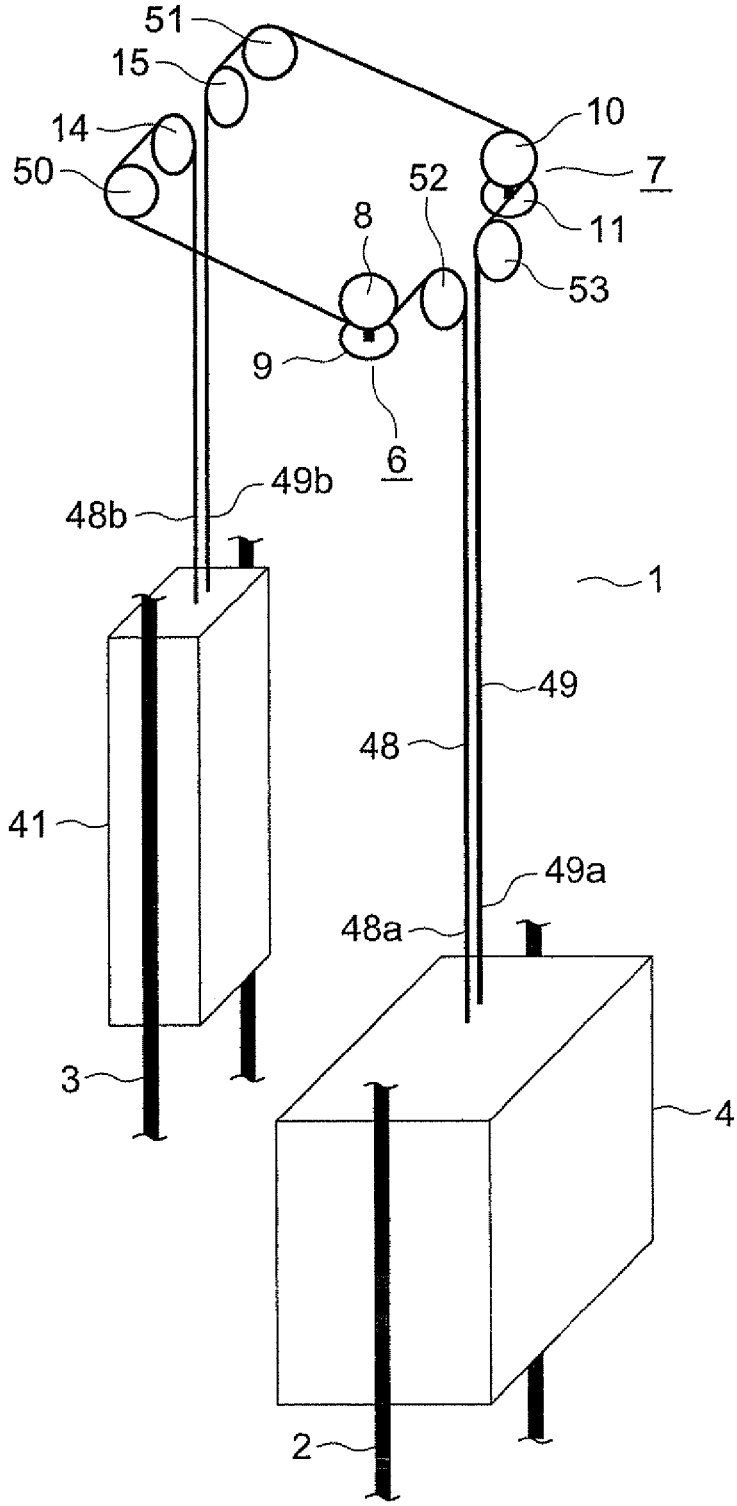
FIG. 10 is a perspective view showing an elevator apparatus according to Embodiment 10 of the present invention.

Reference will be made next to FIG. 10. FIG. 10 is a perspective view showing an elevator apparatus according to Embodiment 10 of the present invention. Referring to FIG. 10, the first turning pulley 50 for turning the main rope 48 from the drive sheave 8 to lead the main rope 48 to the first deflector pulley 14, and the second turning pulley 51 for turning the main rope 49 from the drive sheave 10 to lead the main rope 49 to the second deflector pulley 15 are disposed in the upper portion of the hoistway 1.

The first hoisting machine 6, the second hoisting machine 7, the first turning pulley 50, and the second turning pulley 51 are disposed at four corners in the upper portion of the hoistway 1, respectively. As a result, those portions of the main ropes 48 and 49 which are located between the drive sheaves 8 and 10 and the turning pulleys 50 and 51, respectively, extend parallel to the depth direction of the car 4.

The elevator apparatus constructed as described above also makes it possible to compensate a difference between the running distances of the main ropes 48 and 49 made by the two hoisting machines 6 and 7 without employing endless ropes as the main ropes 48 and 49.

The two hoisting machines 6 and 7 are illustrated in each of Embodiments 1 to 10 of the present invention. However, three or more hoisting machines may be provided. For example, additional hoisting machines may be disposed at the positions of the deflector pulleys 14, 15, 52, and 53.

As a matter of course, a rope with a circular cross-section or a belt-shaped rope may be employed as each of the main ropes 12, 48, and 49.

The invention claimed is:

1. An elevator apparatus comprising:

a plurality of hoisting machines having respective drive sheaves;

at least one main rope wound around and moved respective running distances by rotation of respective drive sheaves;

a car suspended by the main rope and raised and lowered by the hoisting machines;

a counterweight suspended by the main rope and raised and lowered by the hoisting machines, wherein the counterweight includes a first weight body having upper and lower portions, a second weight body having upper and lower portions, and first and second elastically deformable coupling members elastically coupling the upper portion of the first weight body to the upper portion of the second weight body, and coupling the lower portion of the first weight body to the lower portion of the second weight body, respectively, so that displacement in height of the first weight body relative to the second weight body of the counterweight compensates, by elastic deformation of the first and second elastically deformable coupling members, for differences in running distances of the rope produced by different drive sheaves, and the main rope has a first rope end connected to the counterweight on a first weight body side of the counterweight, and a second rope end connected to the counterweight on a second weight body side of the counterweight;

a control device for controlling the hoisting machines; and deformation detecting means for detecting deformation state of the first and second elastically deformable coupling members, wherein the control device counterbalances any difference between running distances of the main rope produced by the hoisting machines in response to a signal from the deformation detecting means.

2. An elevator apparatus comprising:

a plurality of hoisting machines having respective drive sheaves;

at least one main rope wound around and moved respective running distances by rotation of respective drive sheaves;

a car suspended by the main rope and raised and lowered by the hoisting machines;

a counterweight suspended by the main rope and raised and lowered by the hoisting machines, wherein the counterweight includes a first weight body, a second weight body, and an elastically deformable coupling member elastically coupling the first weight body to the second weight body, so that displacement in height of the first weight body relative to the second weight body of the counterweight compensates, by elastic deformation of the elastically deformable coupling member, for differences in running distances of the rope produced by different drive sheaves, the first weight body and the second weight body are spaced apart from each other and are side-by-side, and the coupling member extends horizontally when not deformed; and the main rope has a first rope end connected to the counterweight on a first weight body side of the counterweight, and a second rope end connected to the counterweight on a second weight body side of the counterweight;

a control device for controlling the hoisting machines; and deformation detecting means for detecting deformation state of the elastically deformable coupling member, wherein the control device counterbalances any difference between running distances of the main rope produced by the hoisting machines in response to a signal from the deformation detecting means.

* * * * *